US007451828B2

(12) United States Patent
Marsh

(10) Patent No.: US 7,451,828 B2
(45) Date of Patent: Nov. 18, 2008

(54) DOWNHOLE PRESSURE CONTAINMENT SYSTEM

(75) Inventor: Roger J. Marsh, Palmyra (AU)

(73) Assignee: Baker Hughes Incorporated, Houston, TX (US)

( * ) Notice: Subject to any disclaimer, the term of this patent is extended or adjusted under 35 U.S.C. 154(b) by 113 days.

(21) Appl. No.: 11/415,062

(22) Filed: May 1, 2006

(65) Prior Publication Data

US 2006/0272810 A1 Dec. 7, 2006

Related U.S. Application Data

(60) Provisional application No. 60/688,184, filed on Jun. 7, 2005.

(51) Int. Cl.
*E21B 34/10* (2006.01)

(52) U.S. Cl. ..... 166/386; 166/321

(58) Field of Classification Search ..... 166/386, 166/320, 321

See application file for complete search history.

(56) References Cited

U.S. PATENT DOCUMENTS

| | | | | |
|---|---|---|---|---|
| 6,227,298 | B1 * | 5/2001 | Patel | 166/321 |
| 2001/0023765 | A1 | 9/2001 | Patel | |
| 2001/0030049 | A1 * | 10/2001 | Patel | 166/386 |
| 2006/0016595 | A1 * | 1/2006 | Rioufol et al. | 166/255.1 |
| 2006/0124312 | A1 | 6/2006 | Rytlewski et al. | |

FOREIGN PATENT DOCUMENTS

| | | |
|---|---|---|
| EP | 0 962 625 B1 | 7/2004 |

* cited by examiner

*Primary Examiner*—William P Neuder
(74) *Attorney, Agent, or Firm*—Bracewell & Giuliani LLP

(57) ABSTRACT

An isolation system employing a containment zone within the casing or tubing of a wellbore. The containment zone can be isolated from the wellbore pressure and leak tested to ensure no leakage is occurring across the zone. The isolation system prevents wellbore pressure below the system from communicating with the surface, thereby allowing for safe egress of tools from within the wellbore.

11 Claims, 4 Drawing Sheets

DOWNHOLE PRESSURE CONTAINMENT SYSTEM

RELATED APPLICATIONS

This application claims priority from co-pending U.S. Provisional Application No. 60/688,184, filed Jun. 7, 2005, the full disclosure of which is hereby incorporated by reference herein

BACKGROUND OF THE INVENTION

1. Field of the Invention

The invention relates to wellbore completion operations. More specifically, the present invention relates to an apparatus and method for isolating wellbore pressure during tool removal.

2. Description of Related Art

Certain devices known as downhole tools 12 are inserted into a wellbore 5 for various reasons relating to exploration, completion, and production of a wellbore 5. These tools include imaging devices, retrieval tools, and perforating guns, to name but a few. As is known, these tools are often inserted into the wellbore 5 under pressure. That is the pressure within the wellbore 5 might far exceed the ambient pressure at the surface. Thus, for safety concerns, the differential between the wellbore pressure and the surface pressure must be maintained when inserting or removing downhole tools 12 from the wellbore 5. In order to maintain this pressure differential between pressurized wellbores and the surface, devices known as "lubricators" are often employed to seal around the inserted tool and prevent pressure leakage from the wellbore.

A lubricator is typically comprised of one or more tubular members that form a sealed chamber around a downhole tool. The lubricator is usually attached to a pressure containment spool, such as a valve or blowout preventer at the top of the wellhead. At an upper end of the lubricator, sealing equipment such as a grease injector and/or a stuffing box seals the top of the lubricator, while permitting the downhole tool to be suspended by a downhole tool insertion string, a wireline for example, that extends through the sealing equipment. Thus, a sealed chamber is provided within the lubricator above a closure mechanism of the pressure containment spool e.g. blow out preventer (BOP) or a Christmas Tree. The sealed chamber houses the downhole tool and contains well pressure while the downhole tool is inserted into the wellbore. Pressure between the wellbore and the lubricator is equalized using an equalizer valve or other means by which the pressure above the pressure barrier (e.g. the BOP or Christmas Tree) can be equalized to that below. The closure mechanism of the pressure containment spool is then opened, allowing access to the wellbore. The downhole tool 12 is lowered into the wellbore by manipulating the downhole tool insertion string.

In many instances however, the length of the downhole tool 12 far exceeds that of currently available lubricators. Optionally a valve can be situated within the wellbore 5 to act as a means by which the surface can be isolated from the pressure in the wellbore below the valve. Once the valve is shut, the region above the isolation is bled to atmosphere and the tool 12 is removed from within the wellbore 5. If the isolation valve is not operating properly, this can expose the surface personnel to the possible dangers of full wellbore pressure. Therefore, there exists a need for a method and device capable of safely isolating wellbore pressure from surface pressure that can perform this function during deployment and retrieval of downhole tools.

BRIEF SUMMARY OF THE INVENTION

The present invention includes an isolation system comprising a wellbore tubular, a containment zone disposed within the tubular, an upper isolation valve adjacent the containment zone, a lower isolation valve adjacent the containment zone, a pressure source in communication with said containment zone, and a pressure monitor in communication with the containment zone. The isolation system can further comprise remotely controlled actuators in mechanical cooperation with the upper and lower isolation valves. The upper and lower isolation valves of the isolation system can be ball valves, globe valves, gate valves, slide valves, and butterfly valves.

The isolation system can also include a downhole tool trap. The downhole tool trap can be positioned above the upper isolation valve and comprise a hinged flap. The hinged flap can be selectively placed in a stopping position and in a resting position.

Disclosed herein is also a method of forming a pressure differential within a wellbore comprising, forming a containment zone within the wellbore, creating a pressure seal along the containment zone, venting the region of the wellbore above the containment zone, and verifying the integrity of the pressure seal along the containment zone.

DETAILED DESCRIPTION OF THE INVENTION

Figure 1:
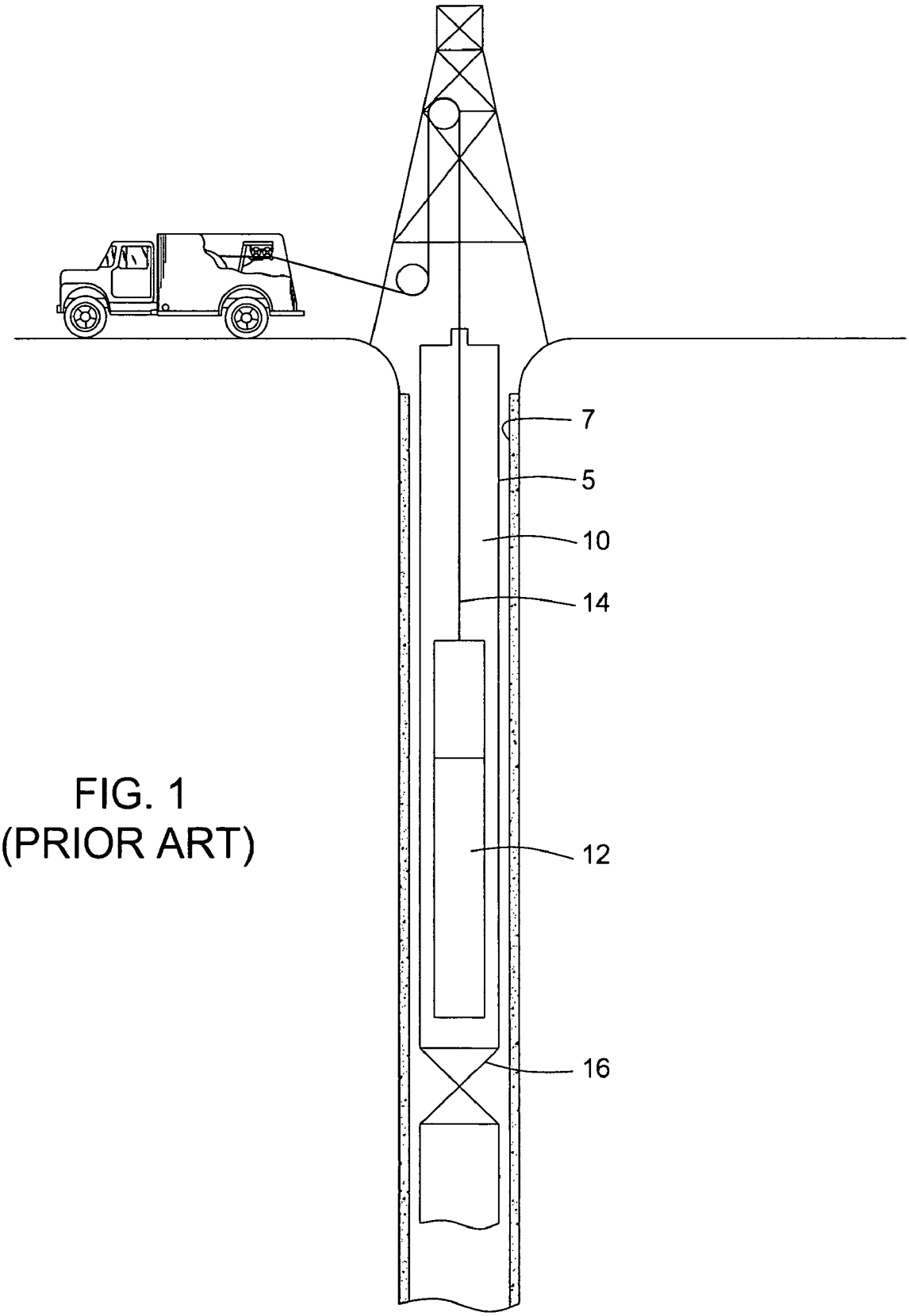
FIG. 1 (PRIOR ART)
FIG. 1 depicts a side cross sectional view of prior art manner of isolating wellbore pressure.
Figure 2:
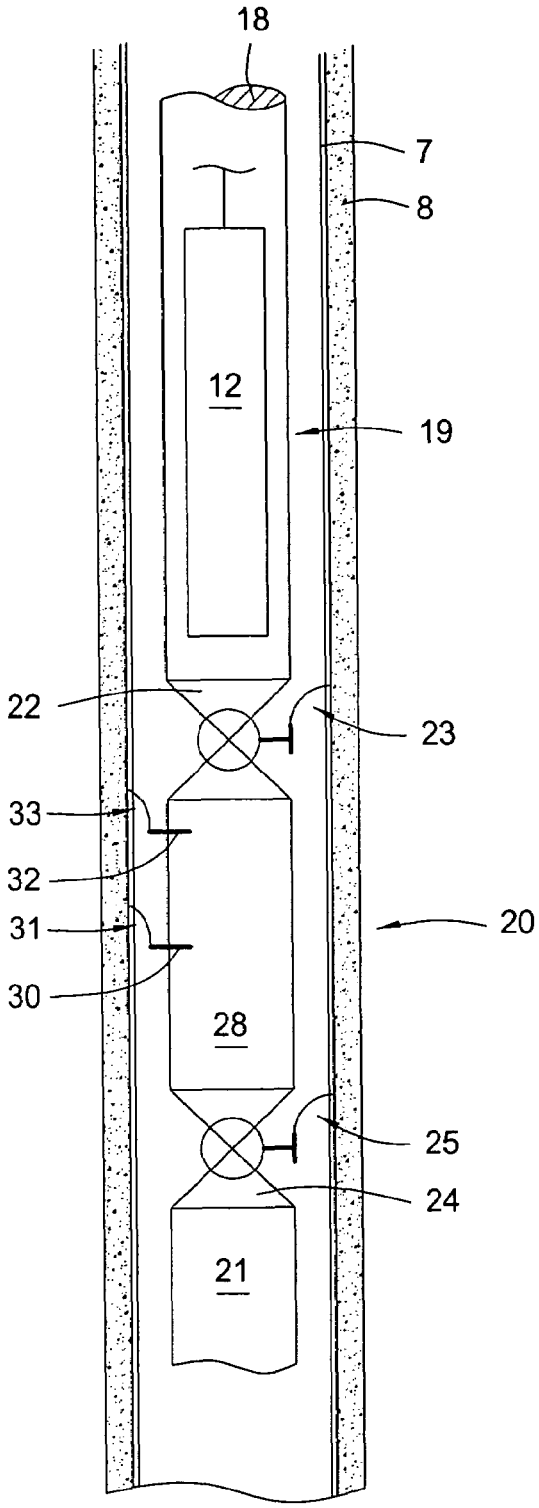
FIG. 2 illustrates a side view of an embodiment of an isolation device.
Figure 3:
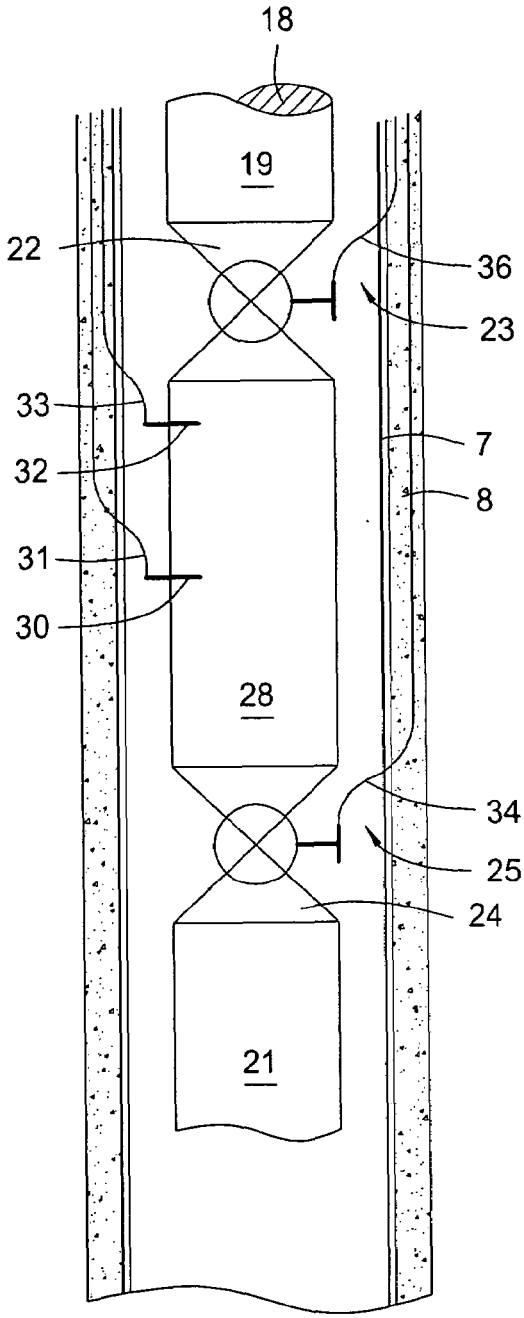
FIG. 3 portrays a side view of an embodiment of an isolation device within a wellbore.

The device and method of the present disclosure provides an isolation system capable of isolating the upper portion of a wellbore 5 from the portion below the isolation system 20. With reference now to FIG. 2, one embodiment of the pressure isolation system 20 is shown in a side view. The isolation system 20 comprises a tubular, such as tubing 18, an upper isolation valve 22 with actuator 23, a lower isolation valve 24 with actuator 25, a fluid supply port 30, and pressure probe 32. It should be pointed out that the tubular can comprise production tubing as shown, but can also be casing or a portion of a production string.

The valves (22, 24) are integral with the tubular as shown and vertically spaced apart along the length of the tubular. The distance between these valves (22, 24) is not important; the valves can be integrated into a single assembly or separated as far apart as required for the particular application. As will be described in more detail below, some advantages exist in maintaining a smaller displacement between the upper and lower isolation valves (22, 24). The valves can be opened or closed by the actuators (23, 25), the operation of the valve actuators (23, 25) can hydraulic, pneumatic, or via telemetry.

When fluids are utilized in operating the actuators (23, 25) operation is provided via the respective actuation control lines (34, 36). The control lines are shown to illustrate their function other systems may be employed to operate the actuators (23, 25). For example, sequencing valves and other systems may be used thereby allowing the number of control lines (34, 36) to be reduced.

The placement of the valves (22, 24) on the tubular provides a containment zone 28 within a portion of the tubular. The valves (22, 24) should be of a design suitable for integral placement within a tubular as well as being capable of sealing against wellbore pressures such that a seal is formed along the containment zone 28. Examples of suitable valves include ball valves, gate valves, globe valves, slide valves, butterfly valves and the like. Accordingly when one or both of these valves is in the closed position, the pressure within the portion of the tubular located above the containment zone 28 is isolated from the portion of the tubular below the containment zone 28. Thus in operation, when it is desired to remove a downhole tool 12 from within the wellbore 5, these valves (22, 24) can be put into their closed position once the tool 12 is raised above the elevation of the upper isolation valve 22.

The operation of the isolation system 20 of the present device involves filling the containment zone 28 with fluid from the fluid supply line 31 via the supply port 30 once the lower isolation valve 24 is shut. The fluid is pumped into the containment zone 28 until the fluid level is above the upper valve 22. The upper valve is then closed and the containment zone 28 is pressurized by pumping additional fluid through the fluid supply line 31 and port 30. The pressure within the containment zone 28 can be measured with the pressure probe 32 or a gauge at surface (not shown) and monitored to ensure the pressure seal is maintained within the zone 28. The pressure test time is not limited by this design but instead can be determined by those skilled in the art without undue experimentation. Once operations personnel are satisfied the isolation system 20 maintains a pressure seal between the upper and lower tubular sections (19, 21), the pressure in the upper tubular 19 can be bled to the surface and the tool 12 removed from within the wellbore 5. Thus by creating a test pressure zone, the integrity of the pressure seal created within the tubular by the containment zone 28 can be verified, which imparts an added measure of safety and assurance that the operations personnel at the surface will not be exposed to an overpressure condition from a high pressure wellbore.

Figure 4:
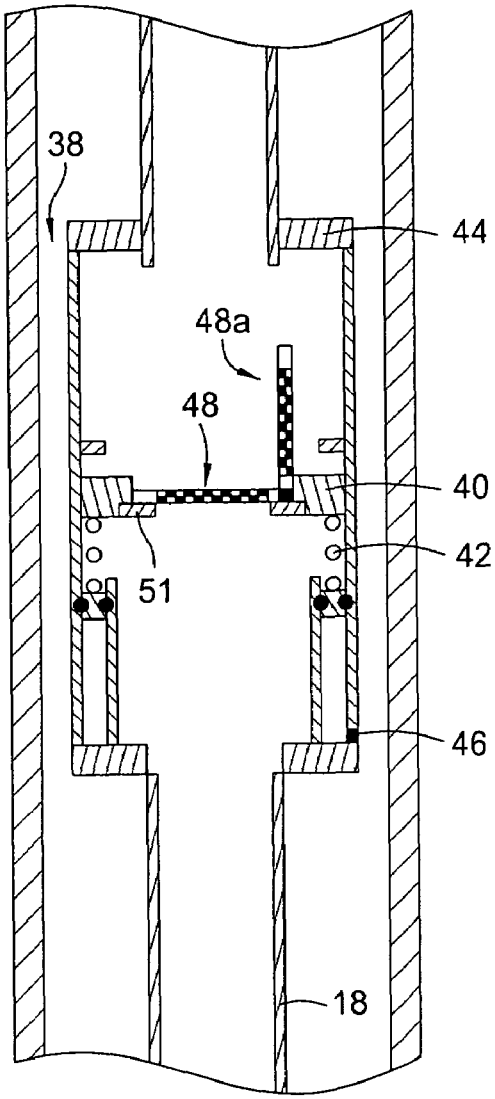
FIG. 4 illustrates a cutaway view of an embodiment of a tool catcher.

Optionally a downhole tool trap 38 can be added within the tubular above the isolation system 20. The downhole tool trap 38 can be useful for stopping tools that may have fallen within the wellbore before reaching and damaging the hardware within the isolation system 20. The downhole tool trap 38 includes a piston 40, spring 42, housing 44, flow restrictor 45, catcher flap 48, and a groove 50. With reference now to FIG. 4, the catcher flap 48 is shown in a horizontal arrangement perpendicular to the axis of the tubing 18. An actuator (not shown) in communication with the valves actuators (23 or 25) can be used to horizontally position the flap 48 when either of these valves (22, 24) is in the closed position. Item 48*a* shows the flap 48 in the open position when the valves (22 and 24) are open.

Figure 5:
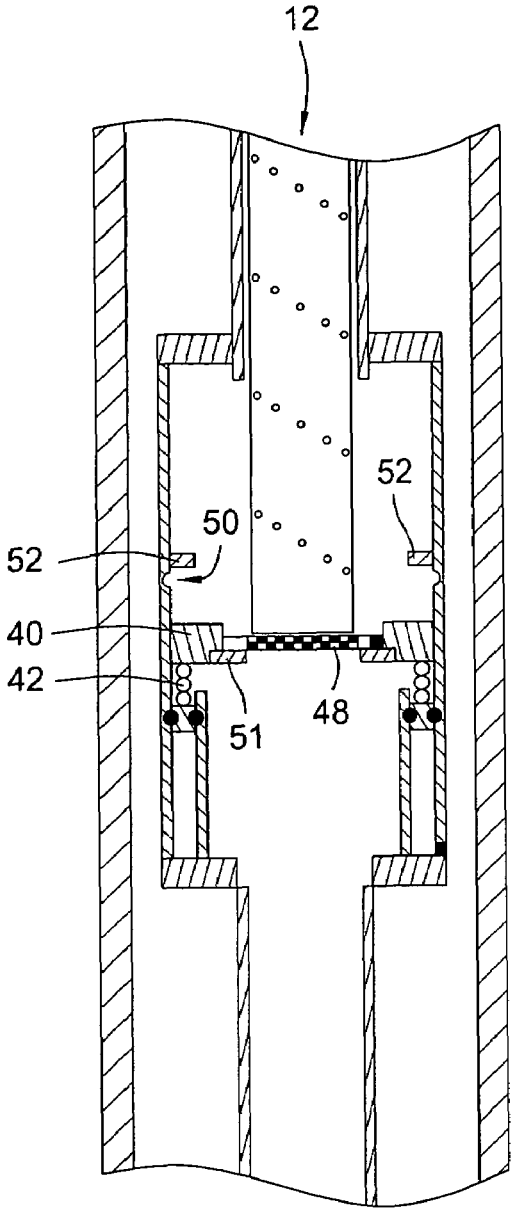
FIG. 5 illustrates a cutaway view of an embodiment of a tool catcher restraining a tool.

With reference now to FIG. 5, a tool 12 is shown resting on the flap 48 after having fallen due to some unforeseen mishap. The piston 40 has moved downward (from its original resting position of FIG. 4) thereby compressing the spring 42. Additional shock absorption is realized with the present device by the addition of the flow restrictor 46 that meters fluid from within the housing 44 to the exterior of the tubing 18. Alternatively, the flow restrictor port can be plugged and the volume beneath the piston filled with a compressible gas, such as nitrogen, which is compressed by the piston. The addition of the compressible gas provides a function similar to a gas filled shock absorber. As seen, the presence of the downhole tool trap 38 can successfully stop the free fall of a tool 12 within the tubing 18 and prevent damage to the isolation system 20 from such an occurrence. A groove 50 is provided on the inner circumference of the housing 44 formed to fit with the outer diameter of the piston 40. The groove 50 can maintain the piston in its rest position (FIG. 4) until sufficient force from a falling tool 12 removes the piston 40 from the groove 50. Also included within the housing 44 is a collar stop 52 and a profile 51 for reseating the piston 40 into the groove 50 after use of the tool catcher 38. A pulling tool (not shown) can be inserted within the wellbore 5 for grasping the profile 51 and pulling the piston 40 upward until the piston 40 hits the collar stop 52 thereby reseating the piston 40 within the groove 50.

Figure 6A:
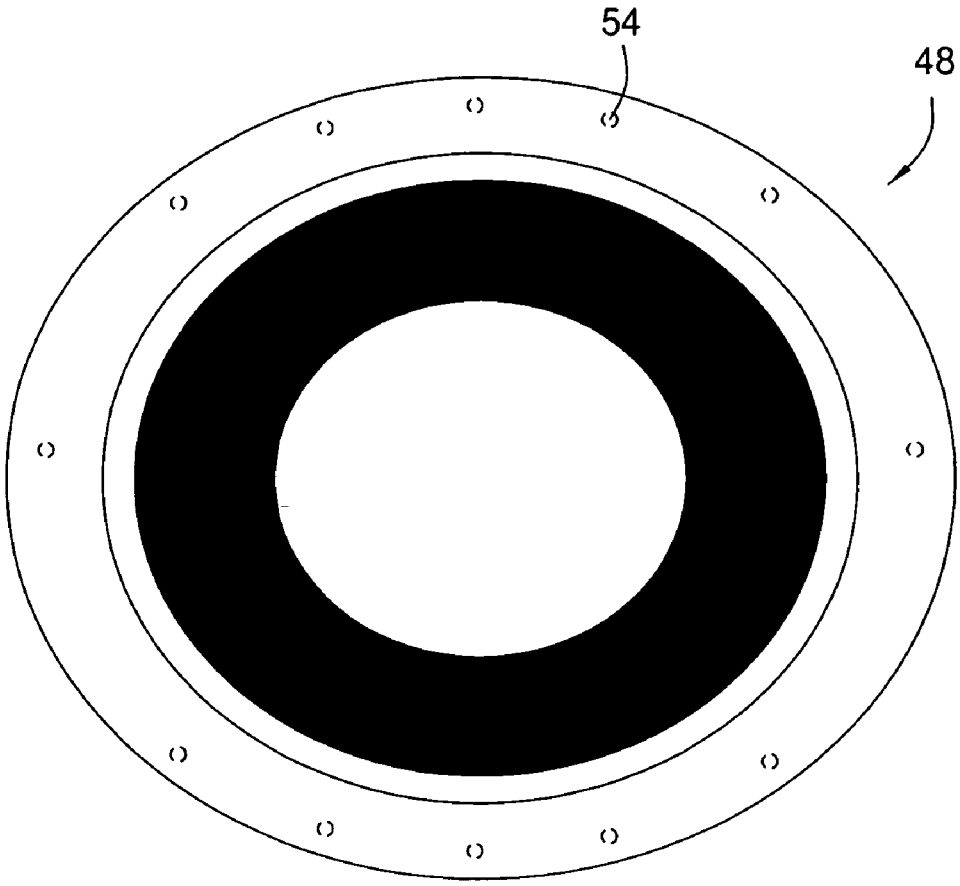
FIG. 6*a* demonstrates an overhead view of an embodiment of catcher flap of a tool catcher.
Figure 6B:
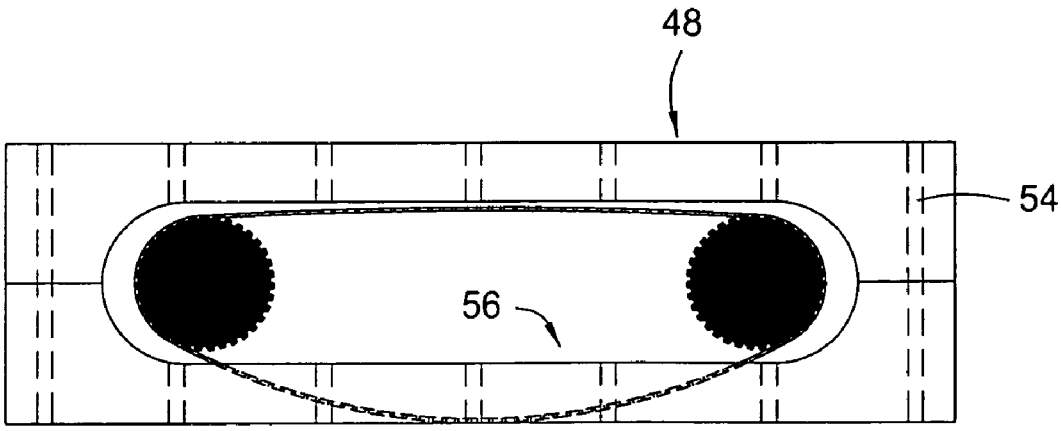
FIG. 6*b* depicts a cutaway view of an embodiment of catcher flap of a tool catcher.

FIG. 6*a* is an overhead view of the catcher flap 48, fluid bypass apertures 54 are provided through the flap 48 for allowing drilling fluid to pass therethrough when the flap 48 is closed. The flap 48 can have a high tensile abrasion resistant composite cover material, such as KEVLAR®, to help withstand the harsh downhole conditions. This covers a preformed spring material 56, which partially absorbs the first impact as the downhole tool or other items hits the flap 48. The downhole tool trap 38 can be run in conjunction with the two valves 22 and 24 or on it's own as additional protection for other designs of sub surface safety valves or impact sensitive devices installed on down hole completions.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, prior to inserting a downhole tool 12 within a pressurized wellbore, the valves (22, 24) could be actuated into the closed position and the upper section 19 could be vented to atmosphere. Also, use of the downhole tool trap 38 is not limited to configurations as disclosed herein, but instead can be used in any downhole application. Moreover, the isolation system 20 of the present disclosure can be utilized with any design of tool catcher and is not limited to use with the embodiment of the downhole tool trap described herein. These and other similar modifications will readily suggest themselves to those skilled in the art, and are intended to be encompassed within the spirit of the present invention disclosed herein and the scope of the appended claims.

What is claimed is:

1. An isolation system within a wellbore comprising:
a containment zone formed within the wellbore;
an upper isolation valve adjacent the containment zone;
a lower isolation valve adjacent the containment zone;
a pressure source in communication with said containment zone;
a leak monitor in communication with said containment zone; and
a downhole tool trap.

2. The isolation system of claim 1, wherein said downhole tool trap is disposed above said upper isolation valve.

3. The isolation system of claim 1, wherein said downhole tool trap comprises a hinged flap.

4. The isolation system of claim 3, wherein said hinged flap is selectively disposable in a stopping position and in a resting position.

5. A method of verifying the integrity of a barrier system within a wellbore comprising:

(a) forming a containment zone within the wellbore, wherein said containment zone is disposed within a barrier system comprising a first barrier and a second barrier;

(b) sealing the first and second barrier;

(c) pressurizing the containment zone to a set pressure; and (d) monitoring the containment zone for a leak.

6. The method of claim 5, wherein the set pressure exceeds the wellbore pressure below the barrier system.

7. The method of claim 5, wherein the wellbore pressure below the barrier system exceeds the set pressure.

8. The method of claim 5, wherein fluid is above the containment zone.

9. The method of claim 5, wherein said wellbore contains a downhole tool, said method further comprising removing said downhole tool.

10. The method of claim 5 further comprising venting the region of the wellbore above the containment zone.

11. The method of claim 5 further comprising disposing a downhole tool within the wellbore.

* * * * *